United States Patent [19]

Kawawa et al.

[11] 4,134,440

[45] Jan. 16, 1979

[54] METHOD OF CONTINUOUSLY CASTING STEEL

[75] Inventors: Takaho Kawawa, Tokyo; Hideki Sato; Shinobu Miyahara, both of Yokohama, all of Japan

[73] Assignee: Nippon Kokan Kabushiki Kaisha, Tokyo, Japan

[21] Appl. No.: 751,618

[22] Filed: Dec. 16, 1976

Related U.S. Application Data

[63] Continuation of Ser. No. 506,633, Sep. 16, 1974, abandoned.

[51] Int. Cl.[2] ..... B22D 11/16

[52] U.S. Cl. ..... 164/4; 164/82; 164/89; 164/413; 164/414; 164/414

[58] Field of Search ..... 164/4, 76, 82, 270, 164/282, 89, 150, 154; 29/527.7; 164/442, 444, 413

[56] References Cited

U.S. PATENT DOCUMENTS 3,812,900 5/1974 Bollig et al. ..... 164/76

FOREIGN PATENT DOCUMENTS 47-40939 10/1972 Japan ..... 164/4

*Primary Examiner*—Francis S. Husar
*Assistant Examiner*—Gus T. Hampilos
*Attorney, Agent, or Firm*—William Anthony Drucker

[57] ABSTRACT

In continuously casting molten steel at least a pair of rolls is disposed near the leading end of the crater at which solidification of the molten steel in the cast piece completes so as to roll the cast piece at a reduction rate of from 0.1 to 2.0%. The variation in the thickness of the cast piece is detected and compared with a definite reference value for controlling the drawing speed and or the quantity of the secondary cooling water.

4 Claims, 7 Drawing Figures

METHOD OF CONTINUOUSLY CASTING STEEL

This is a continuation of Ser. No. 506,633, filed Sept. 16, 1974, now abandoned.

BACKGROUND OF THE INVENTION

This invention relates to a method of continuously casting steel and more particularly to an improved method of continuously casting steel in which the position of the leading end of a crater in the cast piece is maintained at a definite position so as to prevent formation of center porosity at the leading end of the crater, a pipe or segregation and the like defect, thereby producing cast pieces of improved quality by improving the solidifed structure of the metal.

In the method of continuous casting of molten steel it has been the practice to adjust the draw out speed and the quantity of the cooling water such that the leading end of the not yet solidified crater in the cast piece is positioned at the pinch rollers. If the leading end of the not yet solidified crater advances beyond the pinch rolls, the cast piece would not be sufficiently pressed by the pinch rollers with the result that the solidified shell would be bulged outwardly by the static pressure of the molten steel in the crater. As a consequence, it would be impossible to form cast pieces of the desired dimension. Such bulging causes the molten steel remaining at the leading end of the crater and has been enriched with impurities to move toward the leading end of the crater so that the segregation caused by such remaining molten steel presents at the center of the solidified cast pieces. Such bulging also occures even when the roll pitch at the leading end of the crater is large thus causing segregation at the central portion. In each case, it is not desirable for the not yet solidified crater to come ahead of the pinch rollers and many efforts have been made for controlling the position of the leading end of the crater. However, until today, no effective method has been developed. More particularly, according to one method proposed, molten steel is continuously cast under a definite condition, radioactive substance or a substance not soluble in steel such as lead is incorporated into the molten steel before it is cast, so as to cause such substance to precipitate or diffuse to the leading end of the crater and then to solidify, whereby the position of the leading end of the crater can be determined by the position of such target substance. According to another method the position was determined by the calculation of heat conduction. Actually however it is difficult to accurately determine the position of the target substance due to the spacing between pinch rollers or other causes. According to a method disclosed in Japanese Patent Publication No. 40937 of 1972, there are provided mill rolls for reducing the thickness of the cast piece and a mechanism for detecting the rolling reaction. Where the rolling reaction varies rapidly the mechanism operates to control the quantity of the cooling water or the rolling speed. Although this method is effective for cast pieces having a relatively small cross-sectional area such as billets but accompanies a decided difficulty for cast pieces having larger cross-sectional areas such as slabs. More particularly, a slab having a thickness of 200 mm was continuously cast and immediately after its central portion has completely solidified the cast slab was rolled under pressure by mill rolls. Then the reduction rate and the rolling pressure were measured. The rolling pressure W (in ton) can be expressed by the following equation.

$$W\,(\text{ton}) = K \cdot L \cdot Y \cdot \; (Y \leqq 5\%)$$

when K represents a coefficient which varies depending upon the type of the steel and the operating conditions and is generally equal to about from 0.18 to 0.27, L the width of the slab, and Y the reduction rate. From this it can be noted that where K = 0.23 a rolling pressure of 1720 tons is required to reduce 5% a slab having a width of 1500 mm. This means that an extremely large rolling pressure is required even for a small reduction rate. As a result it is necessary to install a mill having rolls of large stiffness and large diameter and a rigid housing. In a continuous casting apparatus, the roll pitch is generally 200–600 mm. from the secondary cooling zone to the pinch rollers. Larger pitch than this value causes the slab to bulge in the direction of thickness under the static pressure of the molten steel inside the crater. For this reason, it is impossible to install a roll housing that can withstand to the rolling pressure which amounts to 2000 tons or more. The roll housing that can be designed to meet said roll pitch requirement can withstand against a pressure of at most about 300 tons. It is clear that such roll can not be used practically.

SUMMARY OF THE INVENTION

Accordingly, it is an object of this invention to provide an improved method of continuously casting molten steel. According to this invention a relatively small rolling pressure is applied to the reducing rolls installed at the leading end of the crater, and the rolling pressure is varied in accordance with the type of steel. The manner of varying the thickness of the cast piece which is rolled by the rolling pressure in accordance with the presence or absence of the leading end of the crater is detected and the detected value is used to control such solidification conditions as the drawing speed and the quantity of the secondary cooling water. Thus, the principal object of this invention is to provide an improved method of continuously casting molten steel capable of forming cast pieces of a definite quality by fixing the leading end of the crater at a definite position, controlling the solidifying speed of the cast pieces to be in a desired range and by controlling the structure of the solidified metal. According to this improved method of continuous casting in which the position of the leading end of the crater in the cast piece is fixed, it is possible to provide at high yields cast pieces having a constant structure and quality after solidification. By sequentially reducing the thickness of the cast piece by 0.1 to 2.0% by means of pairs of rolls it is possible to effectively prevent formation of porous center portion caused by the shrinkage at the time of solidification, and the segregation at the central portion caused by the flow of the molten steel enriched with impurities and remaining at the leading end of the crater into an opening formed by the solidification and shrinkage of the molten steel and to prevent bulging. It is also possible to accurately detect the variation in the thickness of the cast piece caused by successive rolling operations by comparing the thickness after respective rolling operation. This also enables accurate control of the position of the leading end of the crater.

Another object of this invention is to economically carry out the method described above by using a rolling mill of relatively compact construction. As has been pointed out hereinabove, according to this invention the reduction rate of the cast piece is limited to be less than 2%. Even in a large slab, such reduction of small percentage can be accomplish with a relatively small rolling pressure. As a result, the housing of the mill may also be small. It is also possible to select the roll pitch in a relatively narrow range which may be the same as that of the roll pitch of the pinch roller described above.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
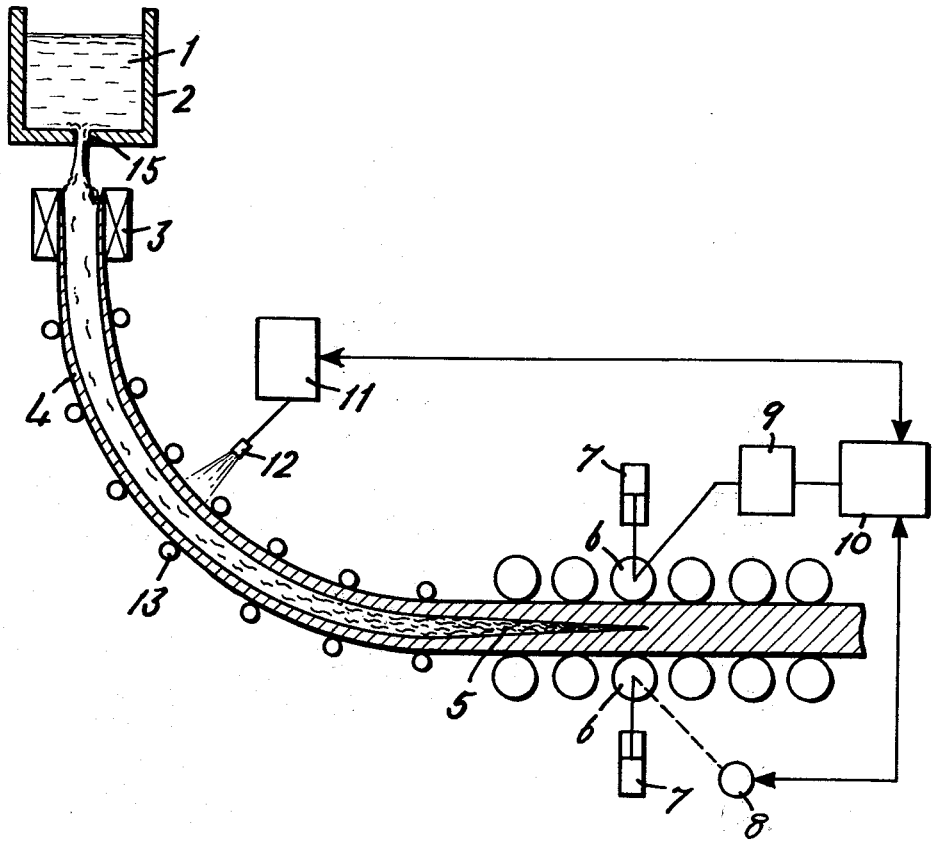
FIG. 1 shows a sectional view, partly in block form of apparatus utilized for carrying out the method of this invention.

As diagrammatically shown in FIG. 1, according to the method of this invention molten steel 1 contained in a suitable container 2, such as a turning dish is poured into a casting mould 3 through a nozzle 15 at the bottom of the container 2 and a cast piece 4 drawn out from the casting mould 3 by pinch rollers 6 while forming a solidified shell in a secondary region, the shell being supported by guide rollers 13. A plurality of pairs of pinch rollers 6 are used each urged against the cast piece 4 by an oil pressure piston 7 and driven by an electric motor 10. In the secondary cooling region is provided a spray nozzle 12 furnished to the water supplying mechanism 11, and spray the cooling water for cooling and solidifying the molten steel.

Figure 2:
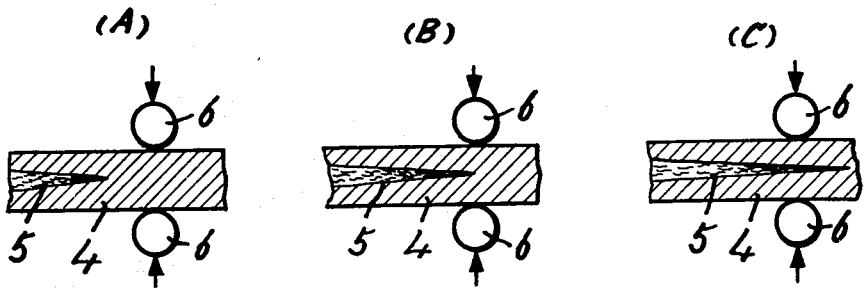
FIGS. 2A, 2B and 2C are partial sectional views showing variation in the relative position of the pinch rollers and the leading end of a crater in a cast piece.
Figure 3:
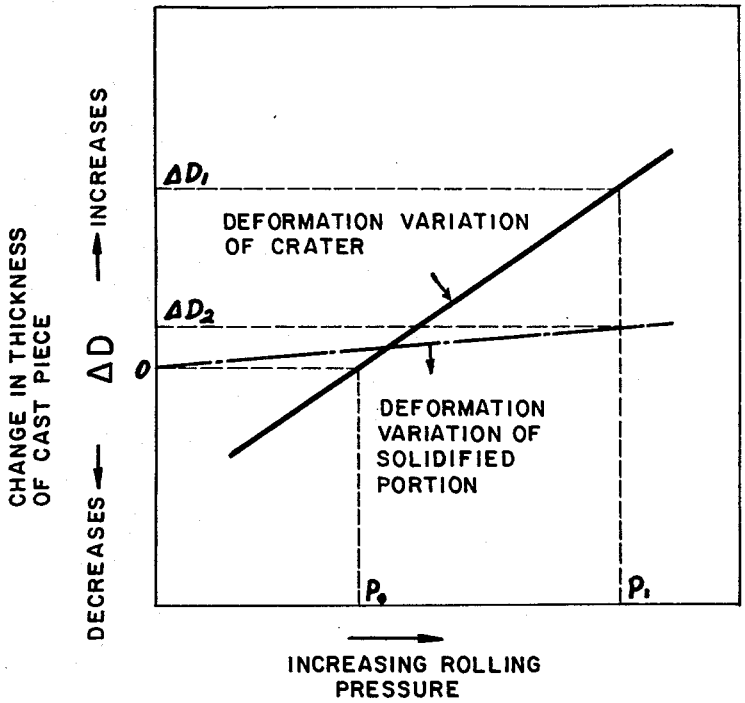
FIG. 3 is a plot showing the relationship between the variation in the crater and perfectly solidified portion of the cast piece and the rolling pressure.

In the method of continuous casting described above, suppose that the position of the leading end of the crater at a pair of pinch rollers 6 varies as shown in FIGS. 2A, 2B and 2C. Under a constant rolling pressure P and normal operating conditions, assume now that the drawing speed is $V_1$, the leading end of the crater 5 is at the position shown in FIG. 2A and that the drawing speed is increased to a certain value. Then the leading end of the crater 5 will reach a position just between the pair of pinch rollers 6 as shown in FIG. 2B. Thereafter, if the drawing speed is increased further to a condition shown in FIG. 2C, and if a steady state drawing speed $V_2$ is reached at that time, the thickness of the cast piece between the pair of pinch rollers would vary. More particularly, when a rolling pressure P is applied between the pair of pinch rollers 6 and when perfectly solidified portion of the cast piece is rolled as shown in FIG. 2A the thickness of the cast piece will not vary in any appreciable extent. However, when the crater comes to a position between the pair of pinch rollers, the shell 4 will not be deformed to any appreciable extent but the crater 5 will be deformed greatly, thus causing a large variation in the thickness of the cast piece because the deformation resistance of molten steel is much smaller than that of the solidified portion of the cast piece. Suppose now that the radius of curvature of a cast piece 4 which is cast by the method shown in FIG. 1 is equal to 10 m and that the rolling pressure of each pinch roller installed at a pitch of 500 mm is equal to 89.4 tons, where the perfectly solidified portion is rolled between the pinch rollers the variation in the thickness of the cast pieces is equal to 0.52 mm whereas when the crater is rolled, the variation in the thickness increases to 2 mm. The relationship between the rolling pressure and the variation in the thickness of the cast piece is generally represented by a graph shown in FIG. 3. In FIG. 3, $P_0$ shows the reduction or rolling pressure corresponding to the static pressure of the molten steel and where the crater advances to a position between the pair of pinch rollers and the rolling pressure is lower than the static pressure $P_0$ of the molten steel the cast piece will be bulged outwardly by said static pressure. On the other hand, where $P > P_0$, the thickness of the cast piece will be decreased greatly. When the portion of the cast piece between the pair of pinch rollers has solidified completely, the amount of deformation is extremely small. In this manner, under a rolling pressure $P_1$ larger than the static pressure $P_0$ of the molten steel there will be a difference between the decrease in the thickness ($\Delta D_1$) of the cast piece caused by the rolling operation and the amount of deformation $\Delta D_2$ of the perfectly solidified portion depending upon the pressure or absence of the crater between the pair of pinch rollers. More particularly, in the absence of the crater, $\Delta D_1 = \Delta D_2$, whereas in the presence of the crater, $\Delta D_1 > \Delta D_2$. The invention contemplates the limiting of the reduction corresponding to $\Delta D_1$ to be less than 2%. By so limiting, even for a large slab having a width of 1500 mm, for example, the rolling pressure of 135.4 tons is sufficient. The mill housing required to withstand against the rolling pressure of such magnitude can be constructed extremely compact at a low cost and such mill of compact design can be installed within the limit of the roll pitch described above.

Figure 4:
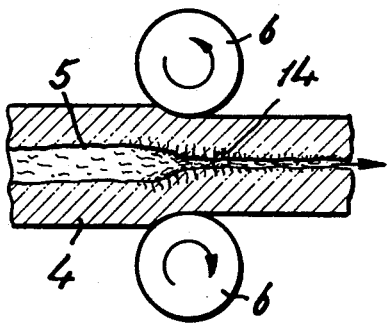
FIG. 4 is a sectional view of explaining the manner of forming defects in a cast piece when a large rolling pressure is applied thereto by pinch rollers.

As shown in FIG. 4, when the rolling pressure $P_1$ applied between a pair of pinch rollers is extremely high, a considerably large tensile stress is created at the interface between the solidified shell and the not yet solidified molten steel thus forming internal cracks 14. The result of our research on the limit of the reduction at which such internal cracks are formed shows that limit ranges from 1.5 to 2.0% of the thickness of the cast piece of an ordinary steel. This fact proves that in order to obtain cast pieces of excellent quality, it is essential to limit the reduction effected by one roll to be within this range. The lower limit of the rolling pressure $P_1$ is determined by the accuracy of the measuring instrument because as the rolling pressure $P_1$ is decreased, the reduction rate is also decreased so that it becomes difficult to accurately measure the variation of the thickness. For this reason, as it is difficult to select a concrete value of the lower limit of the rolling pressure it is generally selected to be in a suitable range in which the variation of the thickness can be accurately determined. Generally speaking, however, the minimum reduction rate should be about 0.1% of the thickness of the cast piece which is determined by considering the structure of the metal after solidification, especially prevention of porosity and segregation at the central portion and the accuracy of the device for detecting the variation in the thickness of the cast piece caused by rolling.

A typical apparatus for measuring the thickness of the cast piece includes a differential transformer, but it is also possible to use any other suitable electrical or mechanical thickness measuring device having an accuracy of less than 0.2 mm.

To have better understanding of the invention, following examples are given.

EXAMPLE 1

Low carbon steel was continuously cast to obtain slabs having a thickness of 200 mm and a width of 1500 mm by using an arcuate continuous casting machine as shown in FIG. 1 and having a radius of curvature of 10 meters. A reference value E was set at 0.5 mm. The reference value E is determined by considering such factors as the type of steel being cast, the thickness of the slab; the drawing spped and the quantity of cooling supplied. It is the desired amount of deformation which takes place between two successive roll pairs of a completely solidified strand corresponding to between 0.1 and 2% deformation and is measured in millimeters. For maintaining the difference in the thicknesses $D_{33}$ and $D_{34}$ of the slab at the thirty third and thirty fourth pinch rollers starting from the casting mould to be less than the reference value 0.5 mm, 1.5% reduction was applied to the slab at each of the thirty second to the fourty second pinch rollers. A drawing speed of 1.0 m/min. was used and the quantity of the secondary cooling water was adjusted to obtain a specific water quantity of 1.54 l/kg of steel.

Differential transormers were used to measure the thicknesses $D_{31}$, $D_{32}$, $D_{33}$ and $D_{34}$ of the slab at respective pinch rollers. It was found that $D_{31}$ = 205 mm, $D_{32}$ = 202 mm and the difference thereof was 3 mm. Further the difference between $D_{32}$ and $D_{33}$ (200 mm) was 2 mm. These differences were larger than the reference value 0.5 mm. However the difference between $D_{33}$ and $D_{34}$ was zero which is smaller than the reference value $\epsilon$. Accordingly, the casting operation was continued without changing the values of the drawing speed and the quantity of the secondary cooling water described above.

Upon inspection of the slabs manufactured under these operating conditions it was found that the porosity and segregation at the central portion were substantially eliminated. FIG. 7 shows the coefficient of segregation at the central portion of the cast pieces. Curve A shows a mean value of the segregation of 36 cast pieces prepared by the prior art method and curves B and C show mean values of the segregation of 16 and 10 cast pieces manufactured by the methods of Examples 1 and 2, respectively. Further, no tendency of bulging was noted.

EXAMPLE 2

The same casting machine as in Example 1 was used. But 0.6% reduction was applied to the slab at each of the thirty second to fourty second pinch rollers. A drawing speed of 0.9 m/min., and a quantity of the secondary cooling water corresponding to a specific water quantity of 1.5 l/kg of steel were used.

The thickness of the slab was measured by differential transformers. It was found that the differences between $D_{31}$ and $D_{32}$ and between $D_{32}$ and $D_{33}$ were both 0 mm, which was smaller than the reference value 0.5 mm under these operating conditions. Accordingly, the speed of the pinch roller driving motor 8 was controlled to increase the drawing speed to 0.98 m/m. At the same time the quantity of the secondary cooling water was increased to 1.54 l/kg. Then, the differences between $D_{31}$ and $D_{32}$ and $D_{32}$ and $D_{33}$ were increased to 2 mm, respectively which is larger than the reference value. However, the differences between $D_{33}$ and $D_{34}$ was 0 mm so that the casting operation was continued without varying the drawing speed of 0.98 m/min. and the quantity of the secondary cooling water of 1.54 l/kg.

Control of the drawing speed and or quantity of secondary cooling water can be readily performed by supplying the result of measuring the deformation between adjacent roll pairs by a measuring instrument 9, as illustrated in FIG. 1, to a computer 10 which in turn controls both the roll driving motor 8 and a water supply control device 11 which regulates the water through nozzle 12.

The porosity and the segregation of the slab were examined but it was found that both were slight. Mean value of the segregation of 16 pieces prepared by the method of this example is shown by curve C in FIG. 7.

CONTROL EXAMPLE 1

Figure 5:
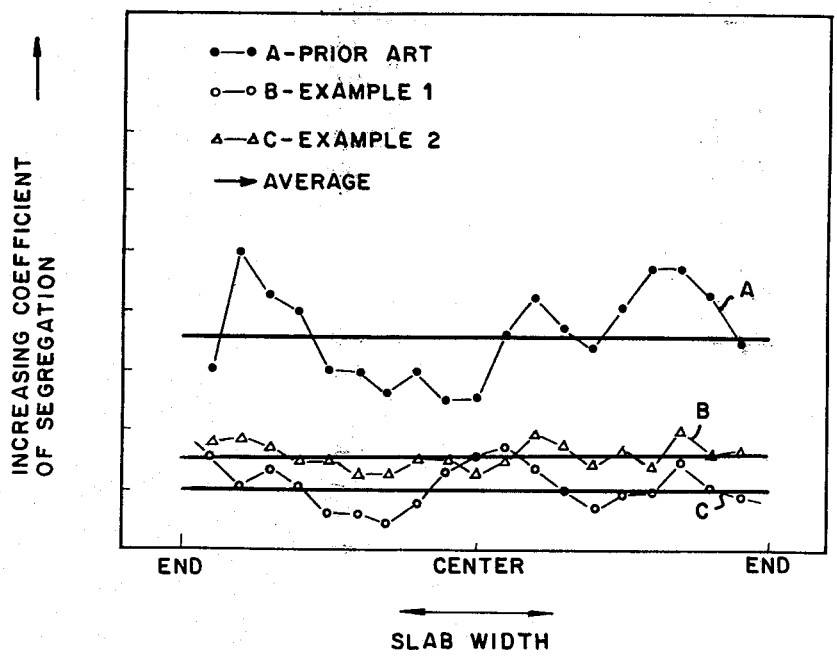
FIG. 5 is a graph for comparing the degree of segregation of the cast pieces manufactured according to the method of this invention and according to a prior art method.

Under the conditions of continuous casting described in Example 1, where 2.5% of reduction was applied to the cast piece at the thirty two to thirty four pinch rollers, a considerable number of internal cracks as shown in FIG. 5 were formed and such internal cracks appeared in a sulfur print as black lines, which were showing said cracks in a microstructure. Further, many defects were noted in a slab obtained by rolling this cast piece.

CONTROL EXAMPLE 2

Under the conditions of continuous casting described in Example 1, where a reduction of less than 0.1% which is impossible to detect with a differential transformer was applied to thirty second to thirty fourth pinch rollers it was found that at a drawing speed of 0.9 m/sec. there were formed center porosity at the central portion of the cast piece due to the solidification and shrinkage caused by bulging and the central segregation caused by the flow of the molten steel remaining at the leading end of the crater and enriched with impurities. Thus, the quality of the resulting slab was not satisfactory in that it contained a number of defects.

We claim:

1. The method of continuously casting molten steel which includes the steps of:

(a) continouously passing molten steel through a mold and allowing said steel to cool and form a cast piece having a length of molten interior extending from said mold to a crater downstream of the mold (b) pre-determining a constant transverse pressure which, when applied to the completely solidified cast piece downstream of the crater, will result in a reduction of the thickness of the cast piece by a reference amount which is not less than 0.1% and not greater than 2%

(c) applying that predetermined constant transverse pressure to the cast piece by opposed pairs of pinch rollers (d) measuring the reduction of thickness at the opposed pairs obtained as a result of step (c)

(e) determining which opposed roller pair represents the beginning of a completely solidified casting by comparing the measured reduction in thickness to the reference amount thereby locating the end of the crater; and (f) modifying the cooling of the cast piece according to any difference where the measured reduction in thickness is approximately the same or considerably larger than the reference amount of reduction in thickness of the roller pair representing the beginning of a completely solidified casting to maintain the position of the end of the crater at a specified distance downstream of the mold.

2. The method according to claim 1 wherein the cooling of the cast piece, to obtain positioning of the crater, is modified by varying the rate of application of cooling water to the cast piece.

3. The method according to claim 1, wherein the cooling of the cast piece, to obtain positioning of the crater, is modified by varying the rate of drawing of the cast piece through the mold.

4. The method according to claim 1 wherein the cooling of the cast piece, to obtain positioning of the crater, is modified by varying the rate of drawing of the cast piece through the mold, and by varying the rate of application of cooling water to the cast piece.

* * * * *